US008449329B1

(12) United States Patent
Schroll

(10) Patent No.: US 8,449,329 B1
(45) Date of Patent: May 28, 2013

(54) CABLE HEADER CONNECTOR HAVING CABLE SUBASSEMBLIES WITH GROUND SHIELDS CONNECTED TO A METAL HOLDER

(75) Inventor: Neil Franklin Schroll, Mount Joy, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 4 days.

(21) Appl. No.: 13/314,415

(22) Filed: Dec. 8, 2011

(51) Int. Cl.
*H01R 13/648* (2006.01)

(52) U.S. Cl.
USPC ..... 439/607.05

(58) Field of Classification Search
USPC ..... 439/607.05, 607.06, 607.41, 607.08, 439/108, 352
See application file for complete search history.

(56) References Cited

U.S. PATENT DOCUMENTS

| | | | | |
|---|---|---|---|---|
| 6,471,549 | B1 | 10/2002 | Lappohn | |
| 6,592,390 | B1 * | 7/2003 | Davis et al. | 439/352 |
| 6,743,057 | B2 * | 6/2004 | Davis et al. | 439/701 |
| 6,749,468 | B2 * | 6/2004 | Avery | 439/701 |
| 6,893,295 | B1 * | 5/2005 | Lloyd et al. | 439/607.05 |
| 7,267,515 | B2 | 9/2007 | Lappohn | |
| 7,410,393 | B1 | 8/2008 | Rothermel et al. | |
| 7,566,247 | B2 | 7/2009 | Rothermel et al. | |
| 7,637,767 | B2 * | 12/2009 | Davis et al. | 439/352 |

* cited by examiner

*Primary Examiner* — Chandrika Prasad

(57) ABSTRACT

A cable header connector includes a contact module having a support body and a plurality of cable assemblies held by the support body. The cable assemblies include contact sub-assemblies configured to be terminated to corresponding cables and ground shields coupled to and providing electrical shielding for corresponding contact sub-assemblies. The support body has a metal holder having a contact plate and a cable plate extending from the contact plate. The ground shields are electrically and mechanically coupled to the contact plate of the metal holder. The cable plate is configured to support the cables extending from the cable assemblies.

20 Claims, 5 Drawing Sheets

CABLE HEADER CONNECTOR HAVING CABLE SUBASSEMBLIES WITH GROUND SHIELDS CONNECTED TO A METAL HOLDER

CROSS REFERENCE TO RELATED APPLICATIONS

This application relates to U.S. patent application titled CABLE HEADER CONNECTOR Ser. No. 13/314,336 filed concurrently herewith, to U.S. patent application titled CABLE HEADER CONNECTOR Ser. No. 13/314,380 filed concurrently herewith, and to U.S. patent application titled CABLE HEADER CONNECTOR Ser. No. 13/314,458 filed concurrently herewith, the subject matter of each of which is herein incorporated by reference in its entirety.

BACKGROUND OF THE INVENTION

The subject matter herein relates generally to cable header connectors.

High speed differential connectors are known and used in electrical systems, such as communication systems to transmit signals within a network. Some electrical systems utilize cable mounted electrical connectors to interconnect the various components of the system.

Signal loss and/or signal degradation is a problem in known electrical systems. For example, cross talk results from an electromagnetic coupling of the fields surrounding an active conductor or differential pair of conductors and an adjacent conductor or differential pair of conductors. The strength of the coupling generally depends on the separation between the conductors, thus, cross talk may be significant when the electrical connectors are placed in close proximity to each other.

Moreover, as speed and performance demands increase, known electrical connectors are proving to be insufficient. Additionally, there is a desire to increase the density of electrical connectors to increase throughput of the electrical system, without an appreciable increase in size of the electrical connectors, and in some cases, a decrease in size of the electrical connectors. Such increase in density and/or reduction in size cause further strains on performance.

In order to address performance, some known systems utilize shielding to reduce interference between the contacts of the electrical connectors. However, the shielding utilized in known systems is not without disadvantages. For instance, at the interface between the signal conductors and the cables signal degradation is problematic due to improper shielding at such interface. The termination of the cable to the signal conductors is a time consuming and complicated process. In some systems, the cables include drain wires, which are difficult and time consuming to terminate within the connector due to their relatively small size and location in the cable. For example, the drain wires are soldered to a grounded component of the electrical connector, which is time consuming. Furthermore, general wiring practices require that the drain either be placed facing upward or placed facing downward at the termination, which adds complexity to the design of the grounded component of the electrical connector and difficulty when soldering the drain wire at assembly. Motion of the cable during handling can add unwanted stresses and strains to the cable terminations resulting in discontinuity or degraded electrical performance. Additionally, consistent positioning of the wires of the cables before termination is difficult with known electrical connectors and improper positioning may lead to degraded electrical performance at the termination zone. When many cable assemblies are utilized in a single electrical connector, the grounded components of the cable assemblies are not electrically connected together, which leads to degraded electrical performance of the cable assemblies.

Some known electrical connectors use contact modules with plastic overmolded housings to hold and position signal leads. The plastic signal assemblies may be fragile. The plastic signal assemblies are flexible by nature. The plastic signal assemblies are subject to warpage from the molding process, which negatively affects the tolerances of the final product.

A need remains for an electrical system having improved structures for supporting signal leads in an electrical connector.

BRIEF DESCRIPTION OF THE INVENTION

In one embodiment, a cable header connector is provided including a contact module having a support body and a plurality of cable assemblies held by the support body. The cable assemblies include contact sub-assemblies configured to be terminated to corresponding cables and ground shields coupled to and providing electrical shielding for corresponding contact sub-assemblies. The support body has a metal holder having a contact plate and a cable plate extending from the contact plate. The ground shields are electrically and mechanically coupled to the Contact plate of the metal holder. The cable plate is configured to support the cables extending from the cable assemblies.

Optionally, the metal holder electrically commons each of the ground shields together. The cable plate may include cable strain relief fingers extending therefrom that are configured to securely hold the cables extending from the cable assemblies. The support body may include a cover attached to the metal holder that is configured to engage the cables to securely hold the cables with respect to the metal holder. Optionally, the cover may be overmolded over the cables to provide strain relief for the cables. The contact plate may include openings with the ground shields having press-fit tabs loaded into the openings to secure the ground shields to the contact plate. The metal holder may include a latch extending therefrom that couples the contact module to a header housing used to hold the contact module. The metal holder may include ground beams extending therefrom that engage a ground shield of another contact module.

In another embodiment, a cable header connector is provided including a contact module having a support body and a plurality of cable assemblies held by the support body. The cable assemblies include contact sub-assemblies configured to be terminated to corresponding cables and ground shields coupled to and providing electrical shielding for corresponding contact sub-assemblies. Each contact sub-assembly has a pair of signal contacts extending between mating ends and terminating ends. The signal contacts are terminated to corresponding signal wires of the cable at the terminating end. The ground shields extend along the signal contacts between the mating and terminating ends. The support body has a metal holder having a contact plate and a cable plate extending from the contact plate. The ground shields are electrically and mechanically coupled to the contact plate of the metal holder. The cable plate has cable strain relief fingers extending therefrom that are configured to securely hold the cables extending from the cable assemblies.

DETAILED DESCRIPTION OF THE INVENTION

Figure 1:
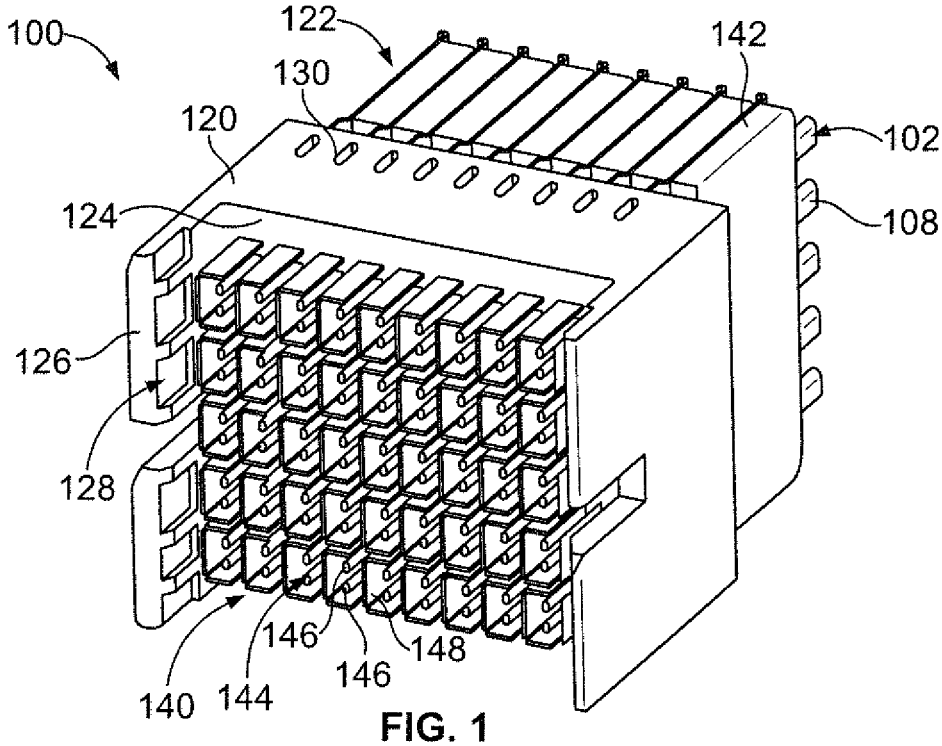
FIG. 1 is a front perspective view of a cable header connector formed in accordance with an exemplary embodiment.
Figure 2:
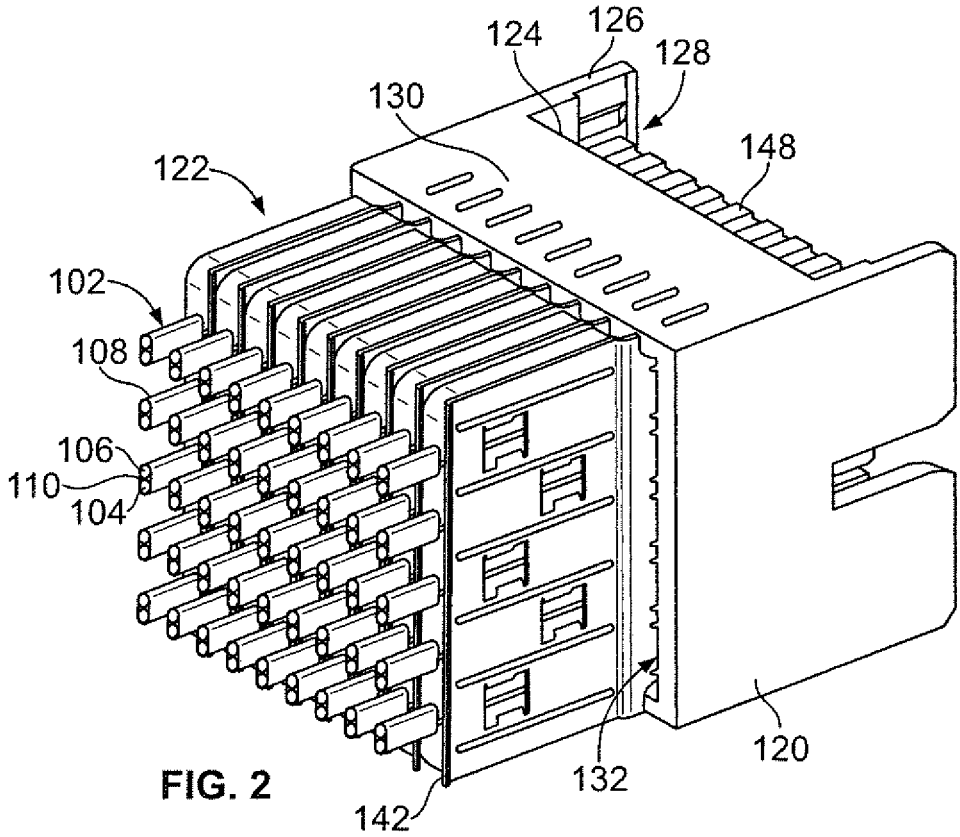
FIG. 2 is a rear perspective of the cable header connector shown in FIG. 1.

FIG. 1 is a front perspective view of a cable header connector 100 formed in accordance with an exemplary embodiment. FIG. 2 is a rear perspective of the cable header connector 100. The cable header connector 100 is configured to be mated with a receptacle connector (not shown). The receptacle connector may be board mounted to a printed circuit board or terminated to one or more cables, for example. The cable header connector 100 is a high speed differential pair cable connector that includes a plurality of differential pairs of conductors mated at a common mating interface. The differential conductors are shielded along the signal paths thereof to reduce noise, crosstalk and other interference along the signal paths of the differential pairs.

A plurality of cables 102 extend rearward of the cable header connector 100. In an exemplary embodiment, the cables 102 are twin axial cables having two signal wires 104, 106 within a common jacket 108 of the cable 102. In an exemplary embodiment, each of the signal wires 104, 106 are individually shielded, such as with a cable braid. The cable braids define grounded elements of the cable 102. A drain wire 110 is also provided within the jacket 108 of the cable 102. The drain wire 110 is electrically connected to the shielding of the signal wires 104, 106. The drain wire 110 defines a grounded element of the cable 102. Optionally, the cable 102 may include a cable braid surrounding the signal wires 104, 106 that defines a grounded element. The signal wires 104, 106 convey differential signals. The grounded elements of the cable 102 provide shielding for the signal wires 104, 106 into the cable header connector 100. Other types of cables 102 may be provided in alternative embodiments. For example, coaxial cables may extend from the cable header connector 100 carrying a single signal conductor therein.

The cable header connector 100 includes a header housing 120 holding a plurality of contact modules 122. The header housing 120 includes a base wall 124. The contact modules 122 are coupled to the base wall 124. In the illustrated embodiment, the header housing 120 includes shroud walls 126 extending forward from the base wall 124 to define a mating cavity 128 of the cable header connector 100. The shroud walls 126 guide mating of the cable header connector 100 with the receptacle connector during mating thereto. In the illustrated embodiment, the header housing 120 has support walls 130 extending rearward from the base wall 124. The contact modules 122 are coupled to the support walls 130. The support walls 130 may include features to guide the contact modules 122 into position with respect to the header housing 120 during mating of the contact modules 122 to the header housing 120. The support walls 130 define a module cavity 132 that receives at least portions of the contact modules 122 therein. The support walls 130 may include latching features that engage the contact modules 122 to secure the contact modules 122 to the header housing 120.

Each of the contact modules 122 include a plurality of cable assemblies 140 held by a support body 142. Each cable assembly 140 includes a contact subassembly 144 configured to be terminated to a corresponding cable 102. The contact subassembly 144 includes a pair of signal contacts 146 terminated to corresponding signals wires 104, 106. The cable assembly 140 also includes a ground shield 148 providing shielding for the signal contacts 146. In an exemplary embodiment, the ground shield 148 peripherally surrounds the signal contacts 146 along the entire length of the signal contacts 146 to ensure that the signal paths are electrically shielded from interference.

The support body 142 provides support for the contact subassembly 144 and ground shield 148. In an exemplary embodiment, the support body 142 engages and provides support for portions of the cables 102. The support body 142 may provide strain relief for the cables 102. In an exemplary embodiment, the support body 142 is manufactured from a metal material. The support body 142 provides additional shielding for the cables 102 and the cable assemblies 140. Optionally, a portion of the support body 142 may be manufactured from a plastic material. For example, portions of the cables 102 may be overmolded with a plastic cover to support the cables 102 and/or provide strain relief for the cables 102. The support body 142 is sized and shaped to fit into the module cavity 132 and engage the support walls 130 to secure the contact modules 122 to the header housing 120.

Multiple contact modules 122 are loaded into the header housing 120. The header housing 120 holds the contact modules 122 in parallel such that the cable assemblies 140 are aligned in a column. Any number of contact modules 122 may be held by the header housing 120 depending on the particular application. When the contact modules 122 are stacked in the header housing 120, the cable assemblies 140 may also be aligned in rows.

Figure 3:
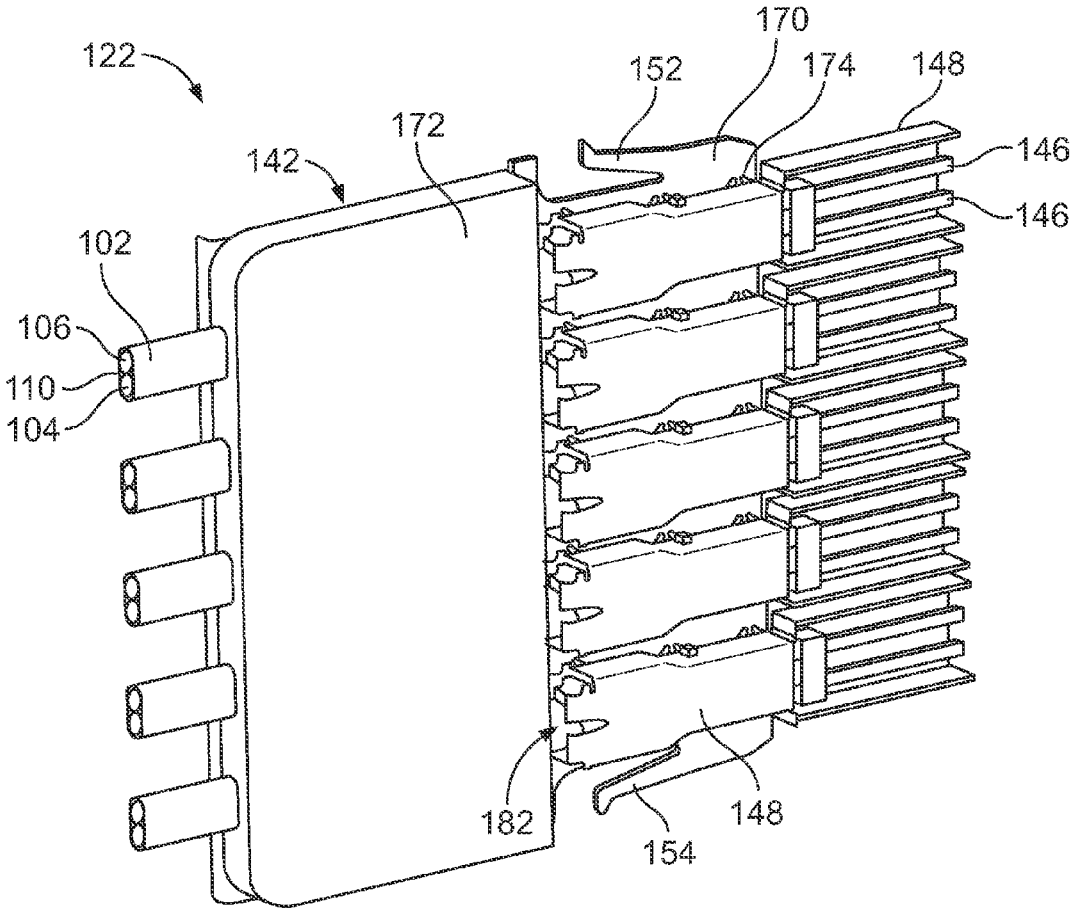
FIG. 3 is a rear perspective view of a contact module for the cable header connector.

FIG. 3 is a rear perspective view of one of the contact modules 122. In an exemplary embodiment, the contact module 122 includes latches 152, 154 that engage corresponding latch elements (e.g. openings) on the header housing 120 (shown in FIGS. 1 and 2) to secure the contact module 122 in the header housing 120. The latches 152, 154 may be integrally formed with the support body 142. Other types of latching features may be used in alternative embodiments to secure the contact module 122 to the header housing 120.

In the illustrated embodiment, the contact module 122 includes a metal holder 170 and a cover 172 coupled to the metal holder 170. The metal holder and cover 170, 172 define the support body 142. The metal holder 170 supports the cable assemblies 140 and/or the cables 102. The cover 172 is attached to the metal holder 170 and supports and/or provides strain relief for the cables 102. In an exemplary embodiment, the cover 172 is a plastic cover. The cover 172 may be overmolded over the cables 102. The cover 172 may be attached to the cables 102 and/or the metal holder 170 by other means or processes in alternative embodiments. For example, the cover 172 may be pre-molded and attached to the side of the metal holder 170 over the cables 102. The cover 172 engages the cables 102 to provide strain relief for the cables 102.

The cable assemblies 140 are mounted to the metal holder 170. The ground shields 148 are coupled directly to the metal holder 170. For example, the ground shields 148 may include press fit features 174 that are press fit into openings 176 (shown in FIG. 8) of the metal holder 170 to attach the ground shields 148 to the metal holder 170. The press fit features 174 are held in the openings 176 by an interference fit. The ground shields 148 may be attached to the metal holder 170 by other features or processes in alternative embodiments, such as using tabs, latches, clips, fasteners, solder, and the like. The ground shields 148 are attached to the metal holder 170 such that the ground shields 148 are mechanically and electrically coupled to the metal holder 170. The metal holder 170 electrically commons each of the ground shields 148.

Optionally, a ground ferrule (not shown) may be coupled to an end 182 of the cable 102. The ground ferrule may be electrically connected to one or more grounded elements of the cable 102, such as the drain wire 110 (and/or the cable braids of the signal wires 104, 106. The ground shield 148 and/or the metal holder 170 may be electrically connected to the ground ferrule to create a ground path between the cable assembly 140 and the cable 102.

Figure 4:
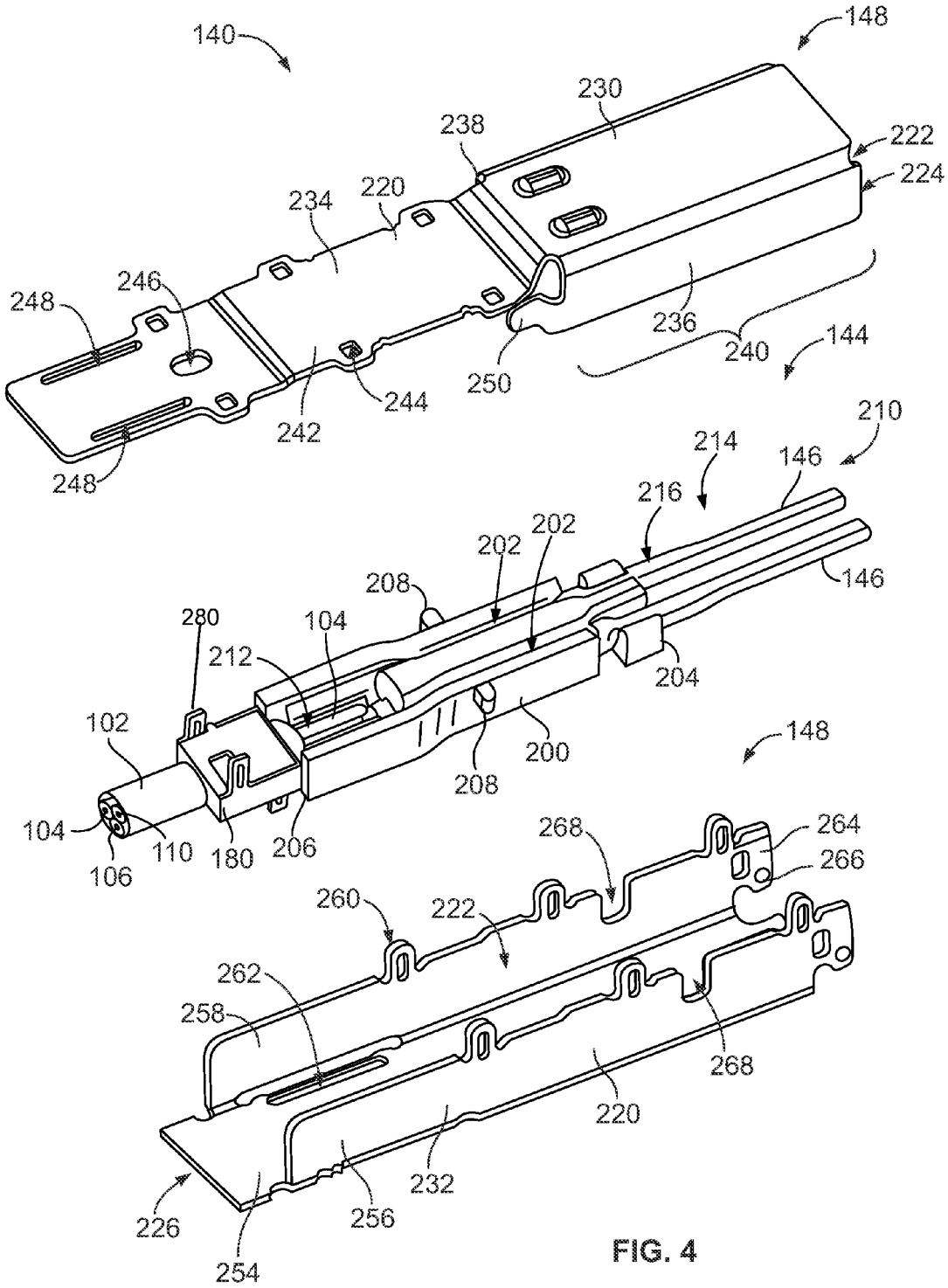
FIG. 4 is an exploded view of a cable assembly of the contact module.

FIG. 4 is an exploded view of one of the cable assemblies 140 illustrating the ground shield 148 poised for coupling to the contact subassembly 144. The contact subassembly 144 includes a mounting block 200 that holds the signal contacts 146. The mounting block 200 is positioned forward of the cable 102. The signal wires 104, 106 extend into the mounting block 200 for termination to the signal contacts 146. The mounting block 200 includes contact channels 202 that receive corresponding signal contacts 146 therein. The contact channels 202 are generally open at a top of the mounting block 200 to receive the signal contacts 146 therein, but may have other configurations in alternative embodiments. The mounting block 200 includes features to secure the signal contacts 146 in the contact channels 202. For example, the signal contacts 146 may be held by an interference fit in the contact channels 202.

The mounting block 200 extends between a front 204 and a rear 206. In an exemplary embodiment, the signal contacts 146 extend forward from the mounting block 200 beyond the front 204. The mounting block 200 includes locating posts 208 extending from opposite sides of the mounting block 200. The locating posts 208 are configured to position the mounting block 200 with respect to the ground shield 148 when the ground shield 148 is coupled to the mounting block 200.

The signal contacts 146 extend between mating ends 210 and terminating ends 212. The signal contacts 146 are terminated to corresponding signal wires 104, 106 of the cable 102 at the terminating ends 212. For example, the terminating ends 212 may be welded, such as by resistance welding or ultrasonic welding, to exposed portions of the conductors of the signal wires 104, 106. Alternatively, the terminating ends 212 may be terminated by other means or processes, such as by soldering the terminating ends 212 to the signal wires 104, 106, by using insulation displacement contacts, or by other means. The signal contacts 146 may be stamped and formed or may be manufactured by other processes.

In an exemplary embodiment, the signal contacts 146 have pins 214 at the mating ends 210. The pins 214 extend forward from the front 204 of the mounting block 200. The pins 214 are configured to be mated with corresponding receptacle contacts (not shown) of the receptacle connector (not shown). Optionally, the pins 214 may include a wide section 216 proximate to the mounting block 200. The wide section 216 is configured to be received in the signal contact openings 160 (shown in FIG. 3) of the header housing 120 (shown in FIG. 3) and held in the signal contact openings 160 by an interference fit. The narrower portions of the pins 214 forward of the wide section 216 may more easily be loaded through the signal contact openings 160 as the contact module 122 is loaded into the header housing 120 due to their decreased size, while the wide section 216 engages the header housing 120 to precisely locate the pins 214 forward of the header housing 120 for mating with the receptacle connector.

The ground shield 148 has a plurality of walls 220 that define a receptacle 222 that receives the contact subassembly 144. The ground shield 148 extends between a mating end 224 and a terminating end 226. The mating end 224 is configured to be mated with the receptacle connector. The terminating end 226 is configured to be electrically connected to the ground ferrule 180 and/or the cable 102. The mating end 224 of the ground shield 148 is positioned either at or beyond the mating ends 210 of the signal contacts 146 when the cable assembly 140 is assembled. The terminating end 226 of the ground shield 148 is positioned either at or beyond the terminating ends 212 of the signal contacts 146. The ground shield 148 provides shielding along the entire length of the signal contacts 146. In an exemplary embodiment, the ground shield 148 provides shielding beyond the signal contacts 146, such as rearward of the terminating ends 212 and/or forward of the mating ends 210. The ground shield 148, when coupled to the contact subassembly 144, peripherally surrounds the signal contacts 146. Because the ground shield 148 extends rearward beyond the terminating ends 212 of the signal contacts 146, the termination between the signal contacts 146 and the signal wires 104, 106 is peripherally surrounded by the ground shield 148. In an exemplary embodiment, the ground shield 148 extends along at least a portion of the cable 102 such that the ground shield 148 peripherally surrounds at least part of the cable braids of the signal wires 104, 106 and/or cable 102, ensuring that all sections of the signal wires 104, 106 are shielded.

The ground shield 148 includes an upper shield 230 and a lower shield 232. The receptacle 222 is defined between the upper and lower shields 230, 232. The contact subassembly 144 is positioned between the upper shield 230 and the lower shield 232.

In an exemplary embodiment, the upper shield 230 includes an upper wall 234 and side walls 236, 238 extending from the upper wall 234. The upper shield 230 includes a shroud 240 at the mating end 224 and a tail 242 extending rearward from the shroud 240 to the terminating end 226. The tail 242 is defined by the upper wall 234. The shroud 240 is defined by the upper wall 234 and the side walls 236, 238. In an exemplary embodiment, the shroud 240 is C-shaped and has an open side along the bottom thereof. The shroud 240 is configured to peripherally surround the pins 214 of the signal contacts 146 on three sides thereof. The upper shield 230 may have different walls, components and shapes in alternative embodiments.

The tail 242 includes press-fit features 244 that are used to secure the upper shield 230 to the lower shield 232. Other types of securing features may be used in alternative embodiments. In the illustrated embodiment, the press-fit features 244 are openings through the upper wall 234.

The tail 242 includes a drain wire opening 246 that receives at least a portion of the drain wire 110. The drain wire opening 246 may receive at least a portion of the ground ferrule 180 in addition to the drain wire 110.

The tail 242 includes ground ferrule slots 248 that receive portions of the ground ferrule 180. The ground ferrule slots 248 may be elongated. The shield 148 may engage the ground ferrule 180 at the ground ferrule slots 248 to electrically couple the ground ferrule 180 to the ground shield 148.

The shroud 240 includes tabs 250 extending rearward from the side walls 236, 238. The tabs 250 are configured to engage the lower shield 232 to electrically connect the upper shield 230 to the lower shield 232.

In an exemplary embodiment, the lower shield 232 includes a lower wall 254 and side walls 256, 258 extending upward from the lower wall 254. The lower shield 232 includes the press-fit features 174 extending from the side walls 256, 258. The press-fit features 174 are configured to engage the press-fit features 244 of the upper shield 230 to secure the lower shield 232 to the upper shield 230. In the illustrated embodiment, the press-fit features 174 are compliant pins that are configured to be received in the openings defined by the press-fit features 244. Other types of securing features may be used in alternative embodiments to secure the lower shield 232 to the upper shield 230. The lower shield 232 may include a drain wire opening (not shown) similar to the drain wire opening 246 of the upper shield 230 that is configured to receive at least a portion of the drain wire 110 and/or the ground ferrule 180. In an exemplary embodiment, the lower shield 232 includes ground ferrule slots 262 in the lower wall 254. The ground ferrule slots 262 may receive portions of the ground ferrule 180.

The lower shield 232 includes tabs 264 extending forward from the side walls 256, 258. The tabs 264 are configured to engage the tabs 250 of the upper shield 230 to electrically connect the upper shield 230 to the lower shield 232. Optionally, the tabs 264 may include embossments 266 that extend from the tabs 264 to ensure engagement with the tabs 250. Optionally, the tops of the tabs 264 may be chamfered to guide mating of the tabs 264 with the tabs 250 during assembly of the ground shield 148.

The lower shield 232 includes openings 268 in the side walls 258. The openings 268 are configured to receive the locating posts 208 when the contact subassembly 144 is loaded into the ground shield 148. Other types of locating features may be used in alternative embodiments to position the contact subassembly 144 with respect to the ground shield 148 and/or to hold the axial position of the contact subassembly 144 with respect to the ground shield 148.

Figure 5:
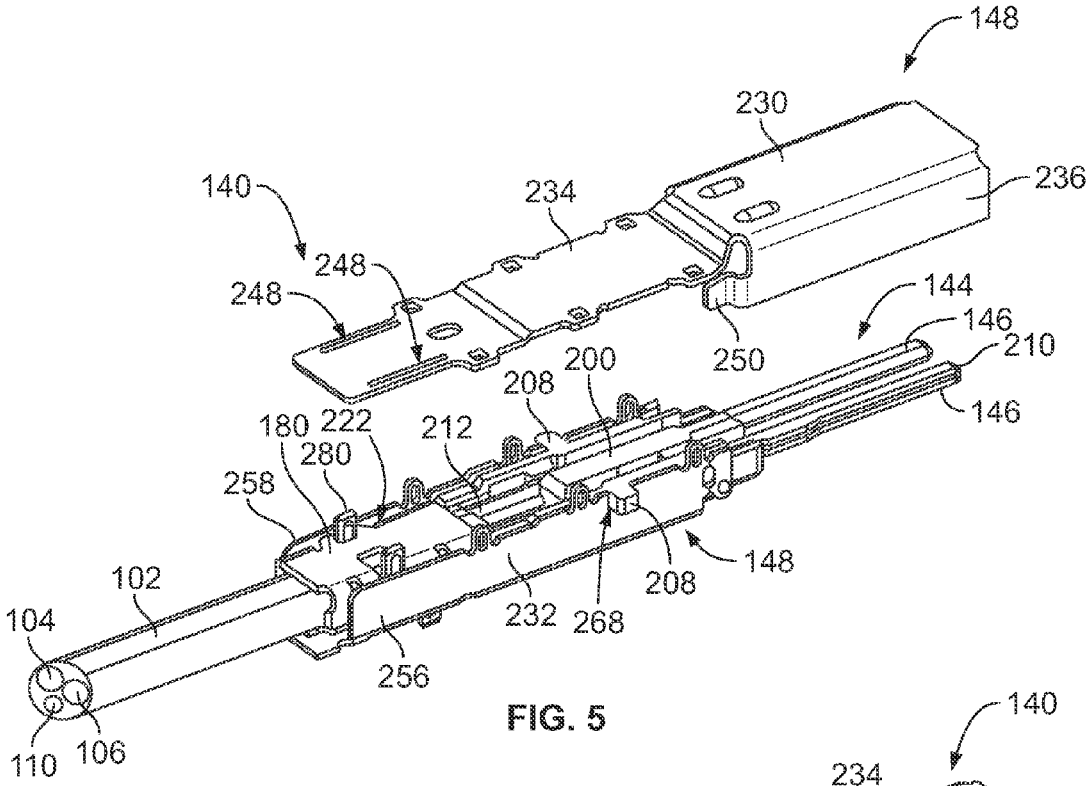
FIG. 5 is a partially assembled view of the cable assembly.
Figure 6:
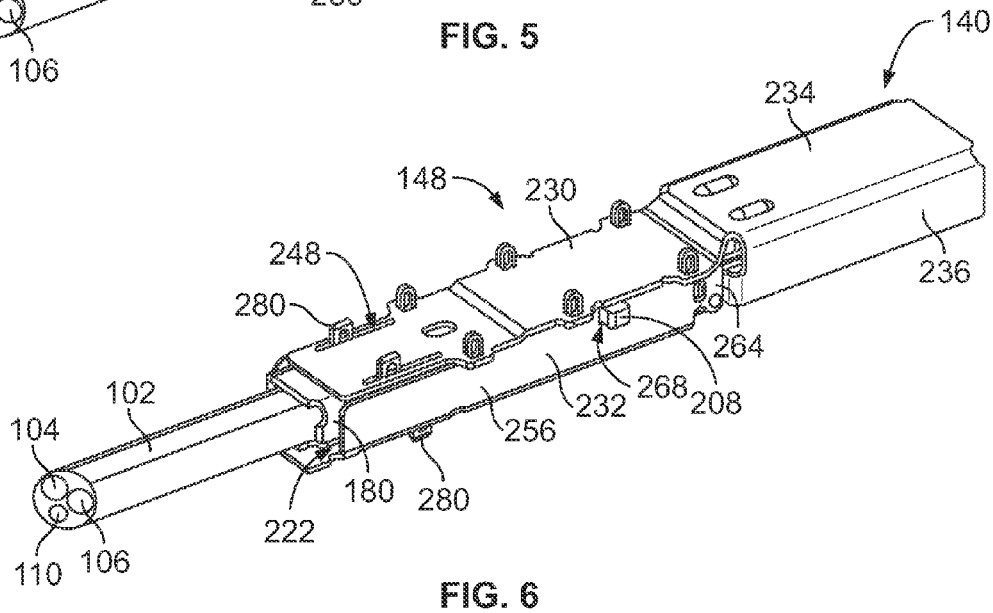
FIG. 6 is a top perspective view of the cable assembly.
Figure 7:
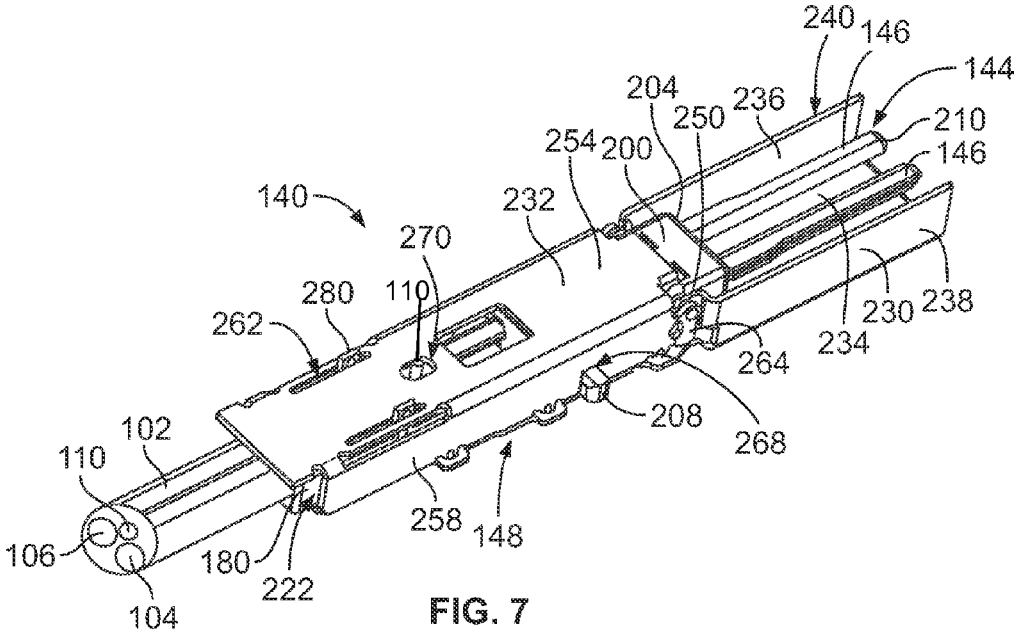
FIG. 7 is a bottom perspective view of the cable assembly.

FIG. 5 is a top perspective view of the cable assembly 140 showing the contact subassembly 144 loaded into the lower shield 232 with the upper shield 230 poised for mounting to the lower shield 232. FIG. 6 is a top perspective view of the cable assembly 140 showing the upper shield 230 coupled to the lower shield 232. FIG. 7 is a bottom perspective view of the cable assembly 140.

When the contact subassembly 144 is loaded into the receptacle 222, the mounting block 200 is positioned within the lower shield 232. The locating posts 208 are received in the openings 268 to secure the axial position of the contact subassembly 144 with respect to the ground shield 148. The ground ferrule 180 and a portion of the cable 102 are also received in the receptacle 222. The ground shield 148 provides peripheral shielding around the ground ferrule 180 and the cable 102. The ground ferrule 180 may be positioned immediately behind, and may engage, the mounting block 200 to provide strain relief for the cable 102 and/or the signal wires 104, 106. As shown in FIG. 7, the drain wire 110 extends through the drain wire opening 270 in the lower wall 254.

When the upper shield 230 and the lower shield 232 are coupled together, the tabs 280 of the ground ferrule 180 extend through the ground ferrule slots 262 of the lower shield 232 and extend through the ground ferrule slots 248 of the upper shield 230. The tabs 280 engage the lower shield 232 and the upper shield 230 to electrically connect the ground ferrule 180 to the ground shield 148. When the upper shield 230 and the lower shield 232 are coupled together, the tabs 250 of the upper shield 230 are held interior of the tabs 264 of the lower shield 232 and create an electrical path between the side walls 236, 238 of the upper shield 230 and the side walls 256, 258 of the lower shield 232.

The ground shield 148 provides electrical shielding for the signal contacts 146. The side walls 256, 258 of the lower shield 232 extend along sides of the signal contacts 146 and along side of the signal wires 104, 106, even within the cable 102. Similarly, the lower wall 254 of the lower shield 232 extends along a bottom of the signal contacts 146 and along a bottom of the signal wires 104, 106, including some length of the signal wires within the cable 102. When the upper shield 230 is coupled to the lower shield 232, the upper wall 234 extends along a top of the signal contacts 146 and the signal wires 104, 106, including some length of the signal wires within the cable 102. The side walls 236, 238 of the upper shield 230 extend along sides of the signal contacts 146. When the upper shield 230 is coupled to the lower shield 232, the side walls 236, 238 of the upper shield 230 engage and are electrically connected to the side walls 256, 258, respectively, of the lower shield 232. Continuous ground paths are created along the sides of the signal contacts 146 by the side walls 236, 238 and the side walls 256, 258. The sides of the signal contacts 146 are continuously covered along the entire length of the signal contacts 146. The upper wall 234 extends along the entire length of the signal contacts 146 to provide electrical shielding above the signal contacts 146 at or beyond the mating ends 210 of the signal contacts 146 to a location rearward of the terminating ends 212. The upper wall 234 may extend along part or all of the ground ferrule 180 thus covering at least a portion of the cable 102. Similarly, the side walls 256, 258 and the lower wall 254 extend rearward beyond the terminating ends 212 and cover at least part of, if not all of, the ground ferrule 180 and at least part of the cable 102.

In the illustrated embodiment, the only portion of the signal contacts 146 that are not directly covered by the ground shield 148 is the bottom of the signal contacts 146 forward of the lower wall 254. However, with reference to FIG. 1, the ground shield 148 of the cable assembly 140 below the open bottom provides shielding along the bottom of the signal contacts 146. As such, within the cable header connector 100, each of the signal contacts 146 have electrical shielding on all four sides thereof for the entire lengths thereof by the ground shields 148 of the cable header connector 100. The electrical shielding extends at or beyond the mating ends 210 of the signal contacts 146 to at or beyond the terminating ends 212 of the signal contacts 146.

Figure 8:
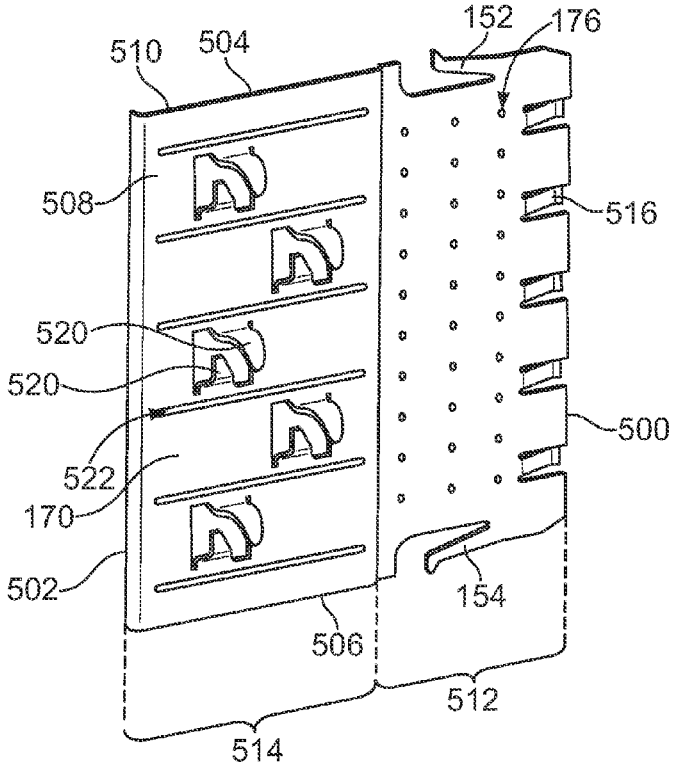
FIG. 8 illustrates a metal holder for the contact module shown in FIG. 3.

FIG. 8 illustrates the metal holder 170. The metal holder 170 extends between a front 500 and a rear 502. The metal holder 170 has a top 504 and a bottom 506. The metal holder 170 has a first side 508 and a second side 510. Optionally, the metal holder 170 may be generally planar. The front 500 of the metal holder 170 is configured to be loaded into the header housing 120 (shown in FIG. 1) during assembly. The latches 152, 154 extend from the top 504 and bottom 506, respectively, and are used to secure the metal holder 170 in the header housing 120. The cable assemblies 140 and the cables 102 (both shown in FIG. 1) are attached to the first side 508 of the metal holder 170. The cover 172 (shown in FIG. 3) is configured to be attached to the first side 508.

The metal holder 170 includes a contact plate 512 proximate to the front 500 and a cable plate 514 proximate to the rear 502. The cable plate 514 may extend from the contact plate 512. The contact plate 512 is configured to engage and support the contact sub-assemblies 144 and/or the ground shields 148 (shown in FIG. 1). The cable plate 514 is configured to engage and support the cables 102.

The contact plate 512 includes a plurality of the openings 176 positioned to receive the press fit features 174 (shown in FIG. 4). The upper shield 230 (shown in FIG. 3) is configured to abut directly against the first side 508 of the contact plate 512. In an exemplary embodiment, the contact plate 512 includes a plurality of ground beams 516 extending therefrom. The ground beams 516 are deflectable beams that are angled out of the plane of the contact plate 512. The ground beams 516 are provided proximate to the front 500. The ground beams 516 are configured to engage a ground shield 148 of another contact module 122 when assembled in the header housing 120. The ground beam 516 electrically commons the metal holder 170 with the ground shield 148 of another contact module 122. Alternatively, the ground beams 516 may engage another grounded component of the other contact module, such as the metal holder 170 of the other contact module 122 or another ground beam of the other metal holder 170, for example.

The cable plate 514 extends from the contact plate 512. Optionally, the cable plate 514 may be shifted slightly toward the cables 102 with respect to the contact plate 512, such as to align the cable plate 514 with the cables 102, while the contact plate 512 is aligned with the ground shield 148. The cable plate 514 extends along the cables 102 and may provide electrical shielding along the cables 102. Optionally, features of the cable plate 514 may engage and be electrically connected to one or more grounded elements of the cable 102.

In an exemplary embodiment, the cable plate 514 includes cable strain relief fingers 520 extending therefrom. The cable strain relief fingers 520 are configured to engage the cables 102 to hold the cables 102 with respect to the metal holder 170. The cable strain relief fingers 520 may be bent or crimped around the cables 102 after the cables 102 are loaded onto the cable plate 514. Optionally, two cable strain relief fingers 520 engage each cable 102, where the cable strain relief fingers 520 extend in different directions and hold opposite sides of the cable 102. Other types of features may be used in alternative embodiments to hold the cables 102. In an exemplary embodiment, when the cover 172 (shown in FIG. 3) is attached to the metal holder 170, such as by being overmolded over the cables 102, the cover 172 engages the cable strain relief fingers 520 to secure the cover 172 to the metal holder 170.

In an exemplary embodiment, the cable plate 514 includes channels 522 extending along the first side 508. The channels 522 are configured to receive a portion of the cover 172. For example, the plastic material forming the cover during the overmolding process may fill the channels 522 to lock the position of the cover 172 with respect to the metal holder 170. The channels 522 may resist up and down movement and/or front and back movement of the cover 172 with respect to the metal holder 170.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A cable header connector comprising:

a contact module having a support body and a plurality of cable assemblies held by the support body;

the cable assemblies comprising contact sub-assemblies configured to be terminated to corresponding cables and ground shields coupled to and providing electrical shielding for corresponding contact sub-assemblies;

the support body having a metal holder having a contact plate and a cable plate extending from the contact plate, the ground shields being electrically and mechanically coupled to the contact plate of the metal holder, the cable plate being configured to support the cables extending from the cable assemblies.

2. The cable header connector of claim 1, wherein the metal holder electrically commons each of the ground shields together.

3. The cable header connector of claim 1, wherein the cable plate includes cable strain relief fingers extending therefrom, the cable strain relief fingers being configured to securely hold the cables extending from the cable assemblies.

4. The cable header connector of claim 1, wherein the support body includes a cover attached to the metal holder, the cover being configured to engage the cables to securely hold the cables with respect to the metal holder.

5. The cable header connector of claim 1, wherein the support body includes a cover attached to the metal holder, the cover being ovemmolded over the cables to provide strain relief for the cables.

6. The cable header connector of claim 1, wherein the contact plate includes openings, the ground shields including press-fit features being loaded into the openings to secure the ground shields to the contact plate.

7. The cable header connector of claim 1, wherein the metal holder extends along the contact sub-assemblies to provide electrical shielding for the contact sub-assemblies.

8. The cable header connector of claim 1, wherein the metal holder includes a latch extending therefrom, the latch being configured to couple the contact module to a header housing used to hold the contact module.

9. The cable header connector of claim 1, wherein the metal holder includes ground beams extending therefrom, the ground beams engaging a ground shield of another contact module.

10. A cable header connector comprising:

a contact module having a support body and a plurality of cable assemblies held by the support body;

the cable assemblies comprising contact sub-assemblies configured to be terminated to corresponding cables and ground shields coupled to and providing electrical shielding for corresponding contact sub-assemblies, each contact sub-assembly having a pair of signal contacts extending between mating ends and terminating ends, the signal contacts being terminated to corresponding signal wires of the cable at the terminating end, the ground shields extending along the signal contacts between the mating and terminating ends;

the support body having a metal holder having a contact plate and a cable plate extending from the contact plate, the ground shields being electrically and mechanically coupled to the contact plate of the metal holder, the cable plate being configured to support the cables extending from the cable assemblies.

11. The cable header connector of claim 10, wherein the metal holder electrically commons each of the ground shields together.

12. The cable header connector of claim 10, wherein the cable plate includes cable strain relief fingers extending therefrom, the cable strain relief fingers being configured to securely hold the cables extending from the cable assemblies.

13. The cable header connector of claim 10, wherein the support body includes a cover attached to the metal holder, the cover being configured to engage the cables to securely hold the cables with respect to the metal holder.

14. The cable header connector of claim 10, wherein the support body includes a cover attached to the metal holder, the cover being overmolded over the cables to provide strain relief for the cables.

15. The cable header connector of claim 10, wherein the contact plate includes openings, the ground shields including press-fit features being loaded into the openings to secure the ground shields to the contact plate.

16. The cable header connector of claim 10, wherein the metal holder includes ground beams extending therefrom, the ground beams engaging a ground shield of another contact module.

17. A cable header connector comprising:

a contact module having a support body and a plurality of cable assemblies held by the support body;

the cable assemblies comprising contact sub-assemblies configured to be terminated to corresponding cables and ground shields coupled to and providing electrical shielding for corresponding contact sub-assemblies, each contact sub-assembly having a pair of signal contacts extending between mating ends and terminating ends, the signal contacts being terminated to corresponding signal wires of the cable at the terminating end, the ground shields extending along the signal contacts between the mating and terminating ends;

the support body having a metal holder having a contact plate and a cable plate extending from the contact plate, the ground shields being electrically and mechanically coupled to the contact plate of the metal holder, the cable plate having cable strain relief fingers extending therefrom, the cable strain relief fingers being configured to securely hold the cables extending from the cable assemblies.

18. The cable header connector of claim 17, wherein the metal holder electrically commons each of the ground shields together.

19. The cable header connector of claim 17, wherein the support body includes a cover attached to the metal holder, the cover being overmolded over the cable strain relief fingers and the cables to provide strain relief for the cables.

20. The cable header connector of claim 17, wherein the metal holder includes ground beams extending therefrom, the ground beams engaging a ground shield of another contact module.

* * * * *